US009996036B2

(12) United States Patent
Ishii et al.

(10) Patent No.: US 9,996,036 B2
(45) Date of Patent: Jun. 12, 2018

(54) IMAGE FORMING APPARATUS CAPABLE OF REDUCING IMAGE BANDING

(71) Applicant: FUJI XEROX CO., LTD., Tokyo (JP)

(72) Inventors: Yasutomo Ishii, Kanagawa (JP); Yu Tsuda, Kanagawa (JP); Shigemi Murata, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/429,990

(22) Filed: Feb. 10, 2017

(65) Prior Publication Data

US 2018/0088504 A1 Mar. 29, 2018

(30) Foreign Application Priority Data

Sep. 23, 2016 (JP) ..... 2016-186229

(51) Int. Cl.
*G03G 15/08* (2006.01)
*G03G 15/00* (2006.01)

(52) U.S. Cl.
CPC ..... *G03G 15/50* (2013.01); *G03G 15/08* (2013.01)

(58) Field of Classification Search
CPC ..... G03G 15/08; G03G 15/50
See application file for complete search history.

(56) References Cited

U.S. PATENT DOCUMENTS 4,989,037 A * 1/1991 Nagatsuna ..... G03G 15/08 100/172
7,209,693 B2 * 4/2007 Tachibana ..... G03G 15/0131 347/116
8,843,037 B2 * 9/2014 Ogawa ..... G03G 15/0189 399/301
2008/0193165 A1 * 8/2008 Nakazawa ..... G03G 15/5033 399/388
2009/0103122 A1 * 4/2009 Horita ..... H04N 1/4078 358/1.9
2010/0239318 A1 * 9/2010 Maehata ..... G03G 15/757 399/167
2011/0280627 A1 * 11/2011 Matsuda ..... G03G 15/5008 399/167
2012/0201552 A1 * 8/2012 Hirai ..... G03G 15/5058 399/49
2012/0315054 A1 * 12/2012 Kubo ..... G03G 15/0189 399/49

(Continued)

FOREIGN PATENT DOCUMENTS

JP 2004-109483 A 4/2004

*Primary Examiner* — David Bolduc
(74) *Attorney, Agent, or Firm* — Sughrue Mion, PLLC

(57) ABSTRACT

Provided is an image forming apparatus including an image holding member that has an outer circumferential surface in which a radius length from a center in the image holding member varies to be the longest N times and the shortest N times during one rotation of the image holding member wherein N is an integer of 2 or more, and that holds a latent image while being rotated, a developing member that develops the latent image of the image holding member with a developer, a rotation unit that rotates the developing member by a number of an integer multiple of the N during the one rotation of the image holding member, and an output unit that outputs a developer image of the image holding member to a recording medium.

4 Claims, 9 Drawing Sheets

(56) References Cited

U.S. PATENT DOCUMENTS

| | | | | |
|---|---|---|---|---|
| 2013/0108288 | A1* | 5/2013 | Kaneko | G03G 15/5058 399/43 |
| 2013/0108292 | A1* | 5/2013 | Suzuki | G03G 15/0189 399/49 |
| 2013/0243456 | A1* | 9/2013 | Kaneko | G03G 13/22 399/48 |
| 2013/0243457 | A1* | 9/2013 | Kaneko | G03G 15/5008 399/49 |
| 2014/0169814 | A1* | 6/2014 | Uematsu | G03G 15/0189 399/49 |
| 2014/0268242 | A1* | 9/2014 | Kaneko | G06K 15/1881 358/3.06 |
| 2014/0270827 | A1* | 9/2014 | Muto | G03G 15/5058 399/49 |
| 2014/0270828 | A1* | 9/2014 | Suzuki | G03G 15/065 399/55 |
| 2014/0301748 | A1* | 10/2014 | Suzuki | G03G 15/5025 399/49 |
| 2015/0362879 | A1* | 12/2015 | Kaneko | G03G 15/556 399/49 |

* cited by examiner

IMAGE FORMING APPARATUS CAPABLE OF REDUCING IMAGE BANDING

CROSS-REFERENCE TO RELATED APPLICATIONS

This application is based on and claims priority under 35 USC 119 from Japanese Patent Application No. 2016-186229 filed Sep. 23, 2016.

BACKGROUND

Technical Field

The present invention relates to an image forming apparatus.

SUMMARY

According to an aspect of the invention, there is provided an image forming apparatus including:

an image holding member that has an outer circumferential surface in which a radius length from a center in the image holding member varies to be the longest N times and the shortest N times during one rotation of the image holding member wherein N is an integer of 2 or more, and that holds a latent image while being rotated;

a developing member that develops the latent image of the image holding member with a developer;

a rotation unit that rotates the developing member by a number of an integer multiple of the N during the one rotation of the image holding member; and an output unit that outputs a developer image of the image holding member to a recording medium.

BRIEF DESCRIPTION OF THE DRAWINGS

Exemplary embodiments of the present invention will be described in detail based on the following figures, wherein.

DETAILED DESCRIPTION

First Exemplary Embodiment

Descriptions will be made on an exemplary image forming apparatus according to a first exemplary embodiment.

(Entire Configuration)

Figure 1:
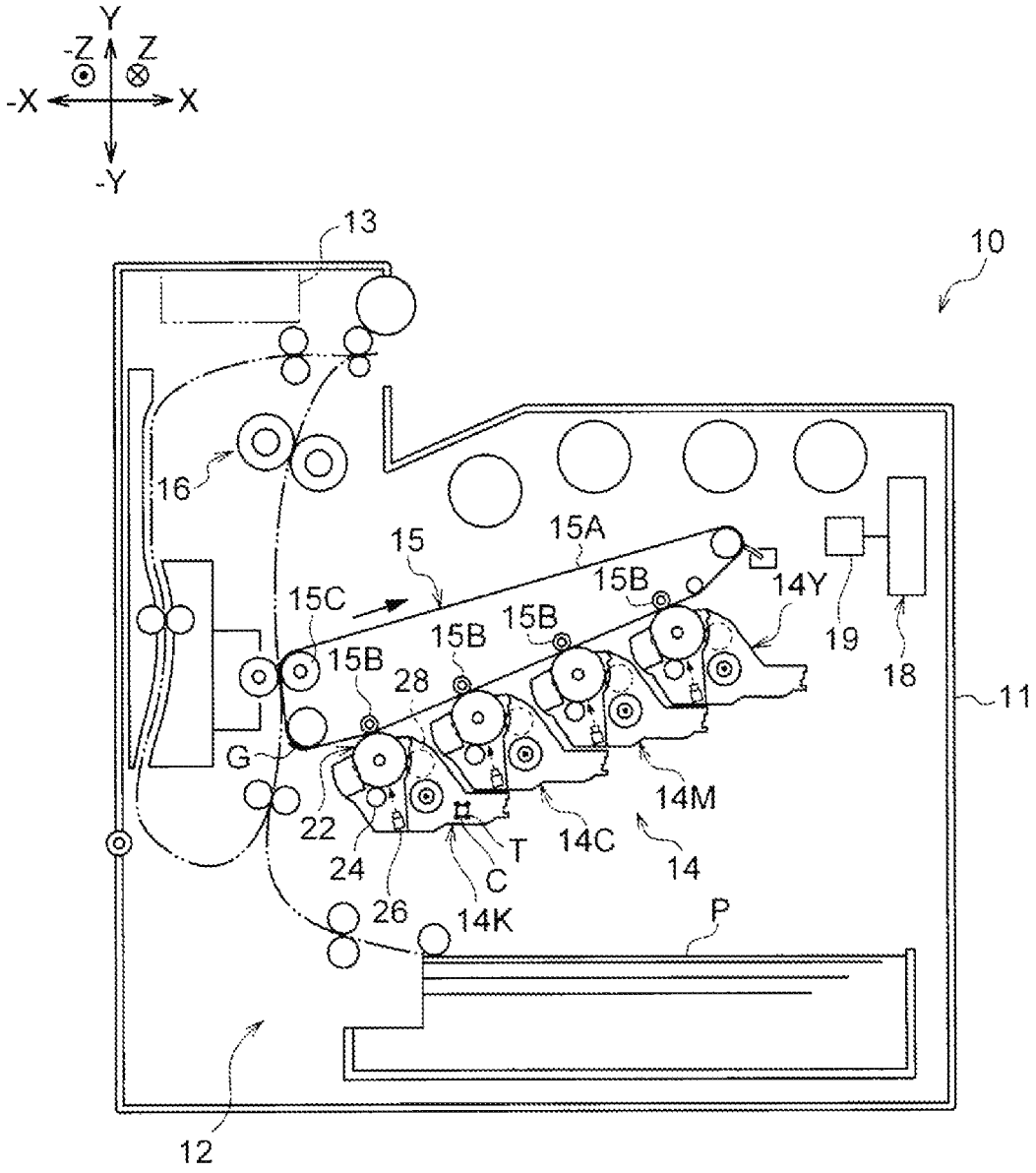
FIG. 1 is a configuration diagram illustrating an image forming apparatus according to a first exemplary embodiment.

FIG. 1 illustrates an image forming apparatus 10 as an example. In the following descriptions, the direction indicated by the arrow Y in FIG. 1 will be regarded as an apparatus height direction, and the direction indicated by the arrow X will be regarded as an apparatus width direction. Further, the direction perpendicular to each of the apparatus height direction and the apparatus width direction (as indicated by Z) will be regarded as an apparatus depth direction. When the image forming apparatus 10 is viewed from the front side, the apparatus height direction, the apparatus width direction, and the apparatus depth direction will be described as a Y direction, an X direction, and a Z direction, respectively. If one side and the opposite side of each of the X direction, the Y direction, and Z direction are required to be discriminated, when the image forming apparatus 10 is viewed from the front side, the upper side will be described as a Y side, the lower side will be described as a −Y side, the right side will be described as an X side, the left side will be described as a −X side, the back side will be described as a Z side, and the front side will be described as a −Z side.

The image forming apparatus 10 includes a box-shaped housing 11. Further, the image forming apparatus 10 includes, for example, a transport unit 12, an operation panel 13, an image forming section 14, a fixing unit 16, and a controller 18, in the housing 11. The transport unit 12 transports a paper P as an example of a recording medium. The operation panel 13 includes a touch panel as an example of an image selecting part, and displays various information about the image forming apparatus 10 or a selection button selected by a user.

The image forming section 14 includes four (4) image forming units 14Y, 14M, 14C, and 14K and a transfer device 15. In addition, the image forming section 14 forms a toner image G on the paper P transported by the transport unit 12, by using a carrier C and a toner T. The carrier C and the toner T are an example of a developer. The toner image G is an example of a developer image. The fixing unit 16 fixes the toner image G on the paper P by heating and pressing the toner image G.

Since the image forming units 14Y, 14M, 14C, and 14K have the same configuration, except for the toner T (yellow, magenta, cyan, or black) to be used, descriptions will be made on the image forming unit 14K, and descriptions of the image forming units 14Y, 14M, and 14C will be omitted.

The image forming unit 14K includes a photoconductor 22 as an example of an image holding member, a charging roller 24, an exposing unit 26, a developing roller 28 as an example of a developing member, and a rotation unit 32 (see FIG. 2) as an example of a rotating part. In the image forming unit 14K, the photoconductor 22 is charged by the charging roller 24 and exposed by the exposing unit 26 so as to form a latent image (not illustrated), and the latent image is developed by the toner T of the developing roller 28 so as to form the toner image G.

The transfer device 15 includes an intermediate transfer belt 15A, four (4) primary transfer rollers 15B that transfer the toner image G onto the intermediate transfer belt 15A from the photoconductor 22, and one (1) secondary transfer roller 15C that transfers the toner image G of the intermediate transfer belt 15A onto the paper P. The transfer device 15 transfers the toner image G of the photoconductor 22 onto the paper P. In addition, the transfer device 15 and the fixing unit 16 are included in an example of an outputting part that outputs the toner image G of the photoconductor 22 as an image to the paper P.

The controller 18, as an example of the outputting part, includes a central processing unit (CPU), a read only memory (ROM), a random access memory (RAM), a memory, a communication line interface (I/F) unit, and a bus (which are not illustrated).

The CPU is an example of a computer and manages the overall operation of the image forming apparatus 10. The ROM stores various programs or parameters in advance. The RAM is used as a work area for the execution of various programs by the CPU. The memory is a nonvolatile memory such as a flash memory. The communication line I/F unit performs transmission and reception of communication data with an external device. The bus electrically connects the respective units of the controller 18 to each other.

The operation panel 13, the respective units of the image forming section 14, and an image correcting unit 19 are connected to the controller 18 via the bus. The controller 18 controls the operations of the respective units of the image forming apparatus 10. Further, the controller 18 causes a portion of the operation panel 13 to display, for example, an operation status of the image forming apparatus 10.

For example, when an image density of the toner image G (an example of an image) transferred onto the paper P and fixed by the fixing unit 16 is higher or lower than a reference density, the image correcting unit 19 performs a correction to make the image density close to the reference density using a software. The detection of the image density is performed, for example, by forming a test pattern of the toner image G on the photoconductor 22 or the intermediate transfer belt 15A and detecting the density of the toner image G using an optical sensor (not illustrated).

[Configuration of Main Components]

Next, the photoconductor 22, the developing roller 28, and the rotation unit 32 will be described in detail.

<Photoconductor>

Figure 2:
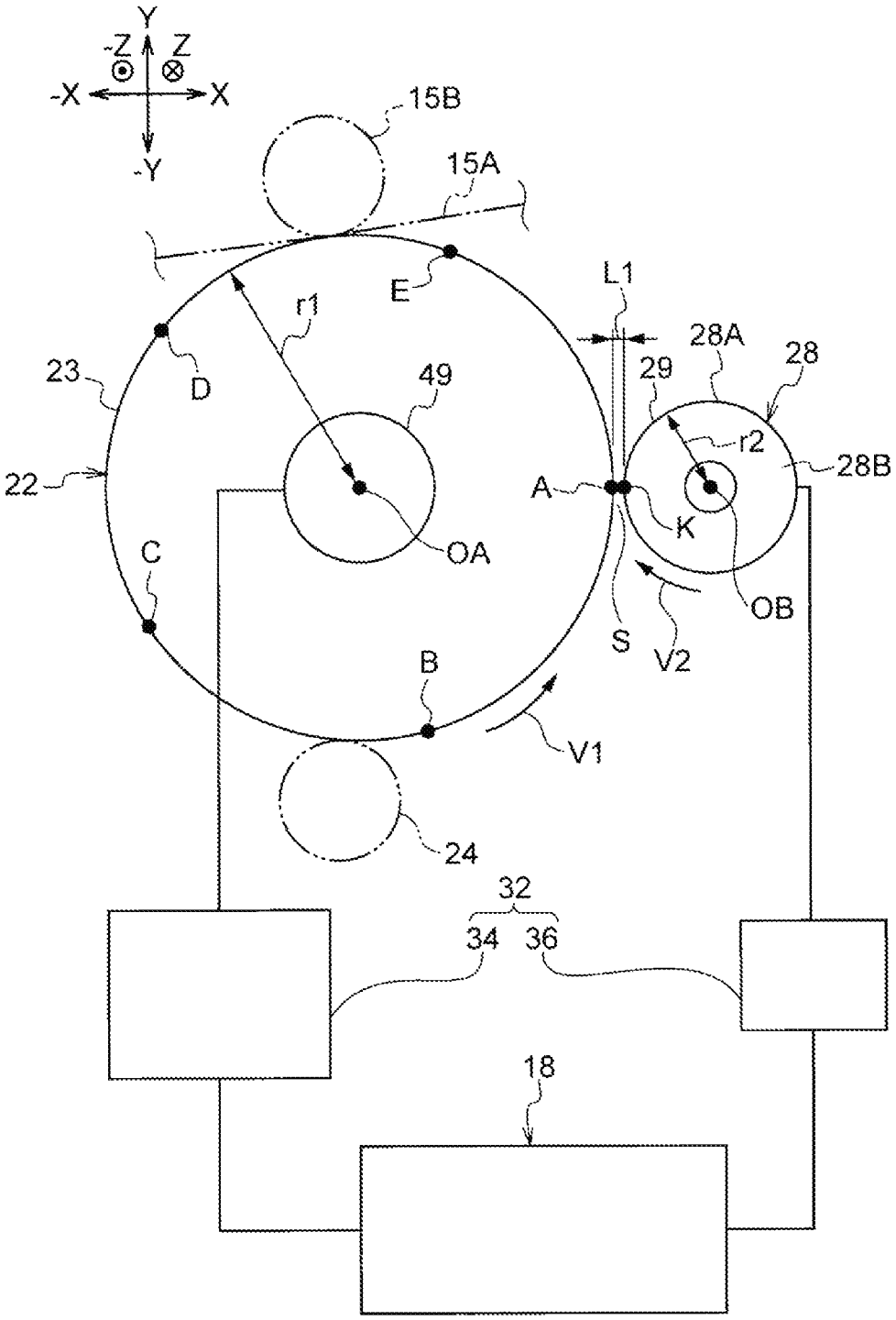
FIG. 2 is a configuration diagram illustrating a photoconductor and a developing roller according to the first exemplary embodiment.

As illustrated in FIG. 2, the photoconductor 22 is formed in a cylindrical shape of which an axial direction is the Z direction. The outer circumferential surface 23 of the photoconductor 22 is charged by the charging roller 24 and exposed by the exposing unit 26 (see FIG. 1) so as to form a latent image (not illustrated), and the photoconductor 22 holds the latent image on the outer circumferential surface 23 while being rotated.

Figure 3A:
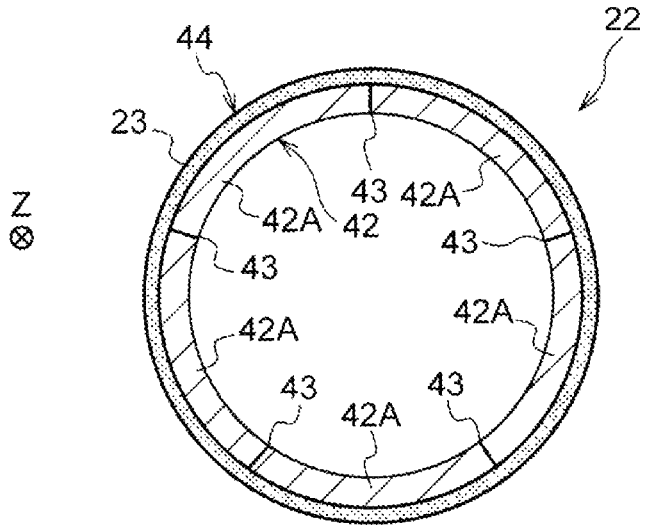
FIG. 3A is an explanatory view schematically illustrating the vertical sectional surface of the photoconductor according to the first exemplary embodiment.

As illustrated in FIG. 3A, the photoconductor 22 is made of, for example, an aluminum material having the axial direction in the Z direction, and includes a base 42 made of a cylindrical core metal, an outer circumferential portion 44 formed on the outer circumferential surface of the base 42, and supporting members 46 and 48 (see FIG. 4) to be described later.

The base 42 is formed, for example, by arranging five (5) plates 42A in the circumferential direction, each plate being curved in a sectional arc shape to the extent of the substantially the same size and by joining the plates with each other at five (5) positions. In other words, for example, the base 42 includes five (5) joints 43 in the circumferential direction. The outer circumferential portion 44 includes an undercoating layer, a charge generating layer, and a charge transport layer (which are not illustrated) that are laminated in the thickness direction of the outer circumferential portion 44 (the radial direction of the photoconductor 22).

Figure 4:
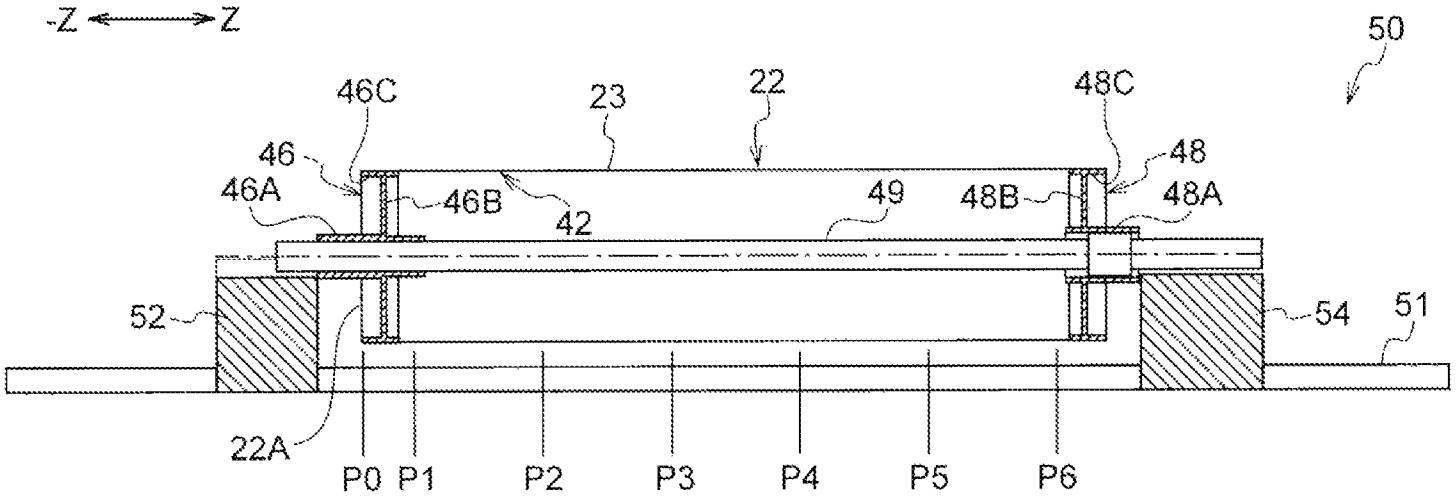
FIG. 4 is an explanatory diagram illustrating a method of measuring a deflection of the outer circumferential surface of the photoconductor according to the first exemplary embodiment.

The supporting member 46 is fitted to the inside of one end in the axial direction (the −Z side end) of the base 42 (see FIG. 4), and the supporting member 48 is fitted to the inside of the other end in the axial direction (the Z side end) of the base 42 (see FIG. 4). In addition, the axial direction of the photoconductor 22 is the Z direction.

The supporting member 46 includes a cylindrical axis portion 46A, a circular plate portion 46B extending in the radial direction of the axis portion 46A, and a flange portion 46C projecting in the Z direction from the outer circumference of the circular plate portion 46B. The supporting member 48 includes a cylindrical axis portion 48A, a circular plate portion 48B extending in the radial direction of the axis portion 48A, and a flange portion 48C projecting in the Z direction from the outer circumference of the circular plate portion 48B. The axis portion 46A and the axis portion 48A are arranged on the same axis (the Z axis). In addition, one cylindrical axis member 49 (see FIG. 4) of which an axial direction is the Z direction is inserted through the axis portion 46A and the axis portion 48A to be integrated therewith.

The axis member 49 of the photoconductor 22 illustrated in FIG. 2 is rotatably supported by a bearing (not illustrated) and driven to be rotated by a first motor 34 of a rotation unit 32 to be described later. Here, when a designed radius length of the photoconductor 22 from the center OA thereof is r1 (meter), the circumferential speed of the outer circumferential surface 23 is V1 (meter/sec), and the circumference ratio of the photoconductor 22 is π, a period of one rotation of the photoconductor 22, i.e., $T1=(2\times\pi\times r1)/V1$ (second). FIG. 2 illustrates positions A, B, C, D, and E as the five positions arranged in the radial direction of the joints 43 (see FIG. 3A) on the outer circumferential surface 23 of the photoconductor 22.

<Developing Roller>

The developing roller 28 illustrated in FIG. 2 includes a cylindrical developing sleeve 28A that is rotatably disposed based on the Z direction as an axial direction, and a magnet roller 28B disposed inside the developing sleeve 28A.

A cap member (not illustrated) is fitted into each of the opposite end portions of the developing sleeve 28A in the Z direction. The cap member is rotatably supported by a bearing (not illustrated) and driven to be rotated by a second motor 36 of the rotation unit 32 to be described later. Specifically, when the developing sleeve 28A is driven to be rotated by the second motor 36, the developing sleeve 28A is rotated in the same direction as the rotation direction of the photoconductor 22, in a development area S facing the photoconductor 22.

Here, when a designed radius length of the developing sleeve 28A from the center OB thereof is r2 (meter), the circumferential speed of the outer circumferential surface of the developing sleeve 28A is V2 (meter/second), and the circumference ratio is π, a period of one rotation of the developing sleeve 28A, i.e., $T2=(2\times\pi\times r2)/V2$ (second). The radius length r2 is smaller than the radius length r1 of the photoconductor 22. In addition, a distance (gap) between the outer circumferential surface 23 of the photoconductor 22 and the outer circumferential surface 29 of the developing sleeve 28A in the development area S is L1. FIG. 2 illustrates a position K as a position of the developing sleeve 28A on the outer circumferential surface thereof which faces a position A of the photoconductor 22 in the development area S in a state where the rotation is stopped.

The magnet roller 28B is a columnar member of which an axial direction is the Z direction, and the opposite end portions of the magnet roller 28B in the Z direction are fixed to a housing (not illustrated) of the image forming unit 14K (see FIG. 1). In addition, the magnet roller 28B is magnetized with plural magnetic poles along the circumferential direction thereof and generates a magnetic force on the outer circumferential surface of the developing sleeve 28A to attract or repel the carrier C and the toner T (see FIG. 1).

<Rotation Unit>

The rotation unit 32 includes the first motor 34 and the second motor 36. The first motor 34 is connected to the axis member 49 via a gear (not illustrated) and drives and rotates the photoconductor 22. The second motor 36 is connected to the cap member (not illustrated) of the developing sleeve 28A via a gear (not illustrated) and drives and rotates the developing sleeve 28A. The driving of the first motor 34 and the second motor 36 is controlled by the controller 18. That is, the controller 18 is included in a portion of the rotation unit 32.

<Image Banding>

Next, an image banding will be described.

Figure 5A:
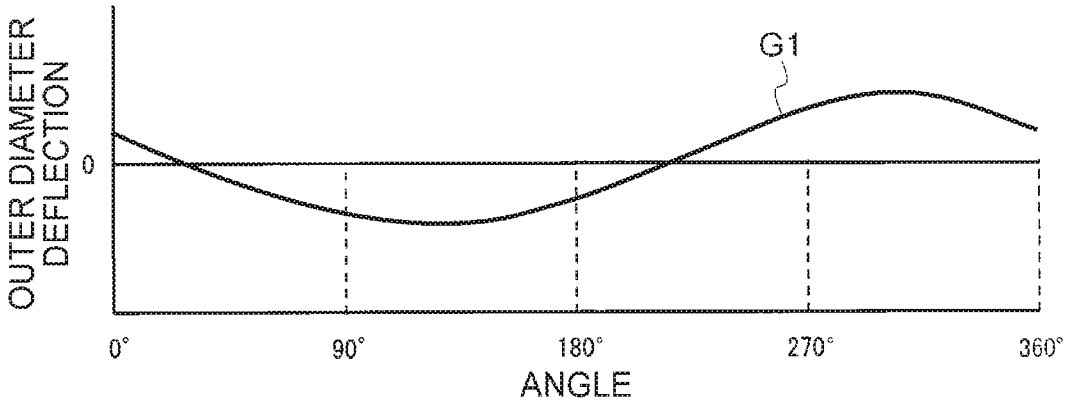
FIG. 5A is a graph schematically illustrating a deflection of the outer circumferential surface of a photoconductor of a comparative example.

As a comparative example, when a photoconductor including a base formed by one member is rotated once and measured using a laser displacement gauge, the sine wave-shaped deflection (graph G1) of the outer circumferential surface as illustrated in FIG. 5A is obtained.

Figure 5B:
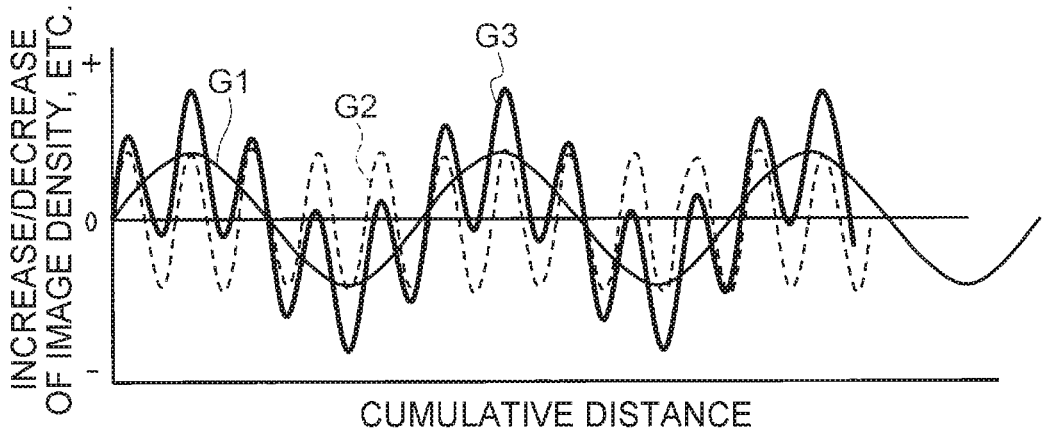
FIG. 5B is a graph illustrating an increase and a decrease of, for example, an image density with respect to a cumulative distance when the photoconductor and the developing roller of the comparative example are used.

Further, when the developing sleeve 28A (see FIG. 2) is rotated once and measured using a laser displacement gauge, the sine wave-shaped deflection (graph G2) illustrated in FIG. 5B is obtained. It is known that when the distance L1 (see FIG. 2) between the outer circumferential surface of the photoconductor and the outer circumferential surface of the developing sleeve 28A varies, the amount of a toner present on the outer circumferential surface of the photoconductor varies, and as a result, the image density of an image output from the image forming apparatus varies. The variation of the image density is referred to as an image banding. That is, a degree of the image banding (an intensity of the image density) correlates with a composite wave (graph G3) which is a combination of the graph G1 for the deflection of the photoconductor and the graph G2 for the deflection of the developing roller. In addition, the amount of the toner supplied to the outer circumferential surface of the photoconductor varies depending on the distance L1 as described above because an electric field intensity (E=V(voltage)/L1 (distance)) in the development area varies, and thus, the force of an electric charge amount q (F=qE) acting on the toner varies.

When the periodicity of the composite wave is low, it is difficult for the above-described image correcting unit 19 (see FIG. 1) to correct the image density with software. In other words, it is easy to correct the image density with software when the image banding has the periodicity.

Here, it is confirmed that in the image forming apparatus 10 illustrated in FIG. 1, for example, when the developing sleeve 28A is rotated three times per rotation of the photoconductor 22, the periodicity of the image banding is low, and the correction of the image density by the image correcting unit 19 (see FIG. 1) is difficult. Since the developing sleeve 28A has the same configuration as that of the developing sleeve of the comparative example, it is believed that the low periodicity of the image banding is attributed to the photoconductor 22. Thus, it is determined to measure the deflection of the outer circumferential surface 23 of the photoconductor 22.

[Deflection Measuring Method]

Next, an exemplary method of measuring the deflection of the outer circumferential surface 23 of the photoconductor 22 will be described.

As illustrated in FIG. 4, a measuring device 50 includes V blocks 52 and 54 spaced apart from each other in the Z direction and fixed to a surface plate 51, and a laser displacement gauge (not illustrated). As the laser displacement gauge, for example, LK-G5000 manufactured by the KEYENCE Corporation is used. The photoconductor 22 is supported by the V blocks 52 and 54 at the opposite end portions of the axis member 49 in the Z direction.

Figure 3B:
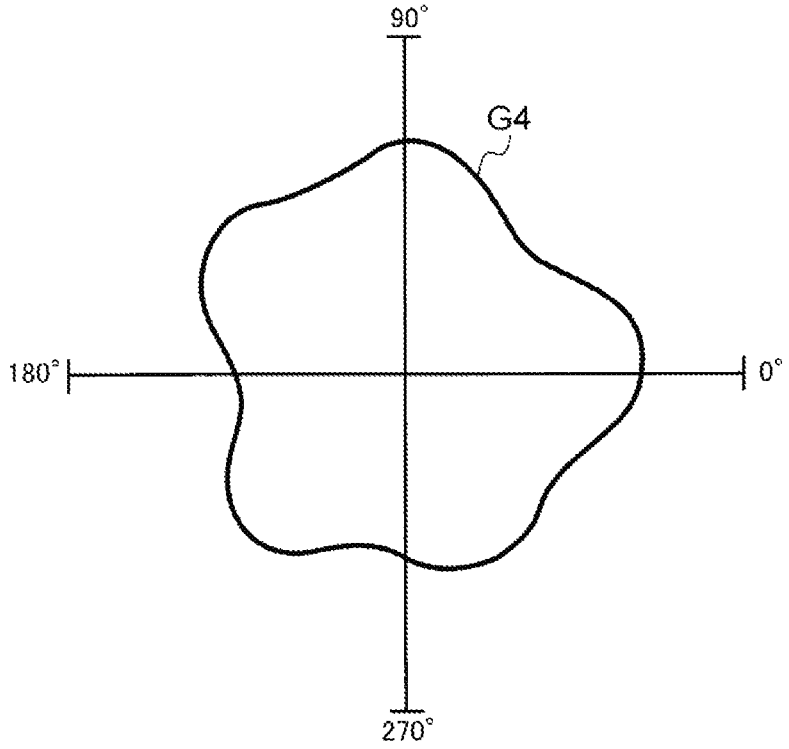
FIG. 3B is a graph indicating a deflection form of the outer circumferential surface of the photoconductor according to the first exemplary embodiment.

It is assumed that the position of the end surface 22A of the −Z side of the photoconductor 22 on the Z axis is a reference position P0. In addition, it is assumed that the positions of a photosensitive layer applying area (not illustrated) of the photoconductor 22 which are 2 mm inwardly apart from the ends of the −Z and Z sides of the photoconductor 22 in the Z direction are positions P1 and P6. In addition, it is assumed that four (4) positions obtained by equally dividing the interval between the positions P1 and P6 into five equal pieces are four positions P2, P3, P4, and P5. For example, when the deflection of the outer circumferential surface 23 of the photoconductor 22 is measured at the position P3, the graph G4 illustrated in FIG. 3B is obtained.

The graph G4 presents the external shape of the outer circumferential surface 23 (see FIG. 2) of the photoconductor 22 in an exaggerated manner. Here, as understood from the graph G4, the outer circumferential surface 23 of the photoconductor 22 is in a flower shape having five (5) petals rather than a circular shape. In addition, it is found that the positions in the circumferential direction corresponding to the vertexes of the five petals are almost the same as the positions in the circumferential direction of the joints 43 (see FIG. 3A) of the photoconductor 22 at the five positions. That is, it is understood that in the photoconductor 22 including the plural joints 43, positions where the deflection of the radius length r1 is the largest and the smallest depending on the number of the joints 43 are highly likely to be present. In other words, the photoconductor 22 has the outer circumferential surface 23 in the form in which the radius length r1 from the center OA (see FIG. 2) varies to become the largest five times and the smallest five times during one rotation of the photoconductor 22.

In the present exemplary embodiment, as an example, one portion where a difference between a maximum value and a minimum value of the deflection is 4 μm or more is regarded as one petal. Hereinafter, descriptions will be made on a method of determining the number of petals when the number of petals of the photoconductor 22 has not been identified.

It is assumed that the joints 43 are present at N positions (N is an integer of 2 or more) when the base 42 of the photoconductor 22 illustrated in FIG. 3A is viewed in the axial direction. In this case, it is assumed that the number of petals is N. Subsequently, in each of the positions P2, P3, P4, and P5 of the measuring device 50 illustrated in FIG. 4, assuming that 360/N(°) is one period, a minimum value (Min) and a maximum value (Max) of the radius length r1 (see FIG. 2) are measured for N periods (corresponding to the circumferential length of the outer circumferential surface 23 of the photoconductor 22). For example, when it is assumed that N=5, one period is 72°.

When measurement results of a first period: Min=x1 and Max=y1, a second period: Min=x2 and Max=y2 . . . , and an $N^{th}$ period: Min=xN and Max=yN are obtained, an average value of the Min and an average value of the Max from the first to $N^{th}$ periods are calculated. Then, when a difference between the average value of the Max and the average value of the Min is 4 μm or more at at least one of the positions P2, P3, P4, and P5, it is determined that the external shape of the photoconductor 22 is a flower shape. In this case, the number of petals is N. When the number of the joints 43 is not determined, the same measurement and calculation may be performed for N=2 to N=10. For example, when the same result is obtained in N=3 and N=6, the side where the value of N is large may be selected.

[Setting Rotation Periods of Photoconductor and Developing Sleeve]

As described above, the photoconductor 22 is formed in the deflection shape having, for example, five (5) petals. In other words, the radius length r1 of the photoconductor 22 (see FIG. 2) varies by five (5) periods during one rotation of the photoconductor 22. Here, it is assumed that when the developing sleeve 28A is rotated by an integer multiple of N=5 during one rotation of the photoconductor 22 illustrated in FIG. 2, an obtained image density has the periodicity. Thus, in the present exemplary embodiment, the rotation unit 32 is set to rotate the developing sleeve 28A by a number of an integer multiple of N=5 (e.g., five (5) rotations) during one rotation of the photoconductor 22. When the above-described periods T1 and T2 are used, T1=5×T2 (second).

In addition, in setting the number of rotations of the developing sleeve 28A, an integer multiple of N includes an upper limit value and a lower limit value.

When the number of rotations of the developing sleeve 28A is smaller than a preset reference range for the number of rotations (when the rotation speed is overly slow), a lack of supply of the toner T to the photoconductor 22 occurs. Further, when the rotation speed of the developing sleeve 28A is overly slow, a contact time of the photoconductor 22 with the toner T and the carrier C becomes longer than a reference contact time, and electric charges are injected into the carrier C so that the carrier C is scattered toward the photoconductor 22 side. Thus, since the toner T may not be attached at the position where the carrier C is scattered, an image loss may occur.

Meanwhile, when the number of rotations of the developing sleeve 28A is larger than the preset reference range for the number of rotations (when the rotation speed is overly fast), the centrifugal force acting on the carrier C held on the outer circumferential surface of the developing sleeve 28A increases. When the centrifugal force becomes larger than the magnetic force (the holding force) of the magnet roller 28B, the carrier C may be scattered toward the photoconductor 22 thereby causing the image loss. In addition, when the number of rotations of the developing sleeve 28A increases, a frictional force between a trimmer (a regulating member) and the carrier C/the toner T increases thereby generating heat, and as a result, the carrier C and toner T may be deteriorated. As described above, in setting the number of rotations of the developing sleeve 28A, an integer multiple of N may not be always favorable and is required to be set in consideration of upper and lower limit values.

[Operation]

The operation of the image forming apparatus 10 according to the first exemplary embodiment will be described with reference to FIGS. 1 to 4, 5A, 5B, 6A and 6B.

The rotation unit 32 rotates the developing sleeve 28A five times which is an integer multiple of the period (N=5) of the external shape variation of the photoconductor 22 during one rotation of the photoconductor 22. Thus, the variation period of the radius length r1 of the photoconductor 22 (see FIG. 2) conform to an integer multiple (here, one time) of the variation period of the radius length r2 of the developing sleeve 28A (see FIG. 2) so that the variation of the distance L1 between the photoconductor 22 and the developing sleeve 28A becomes periodic (regular).

Figure 6A:
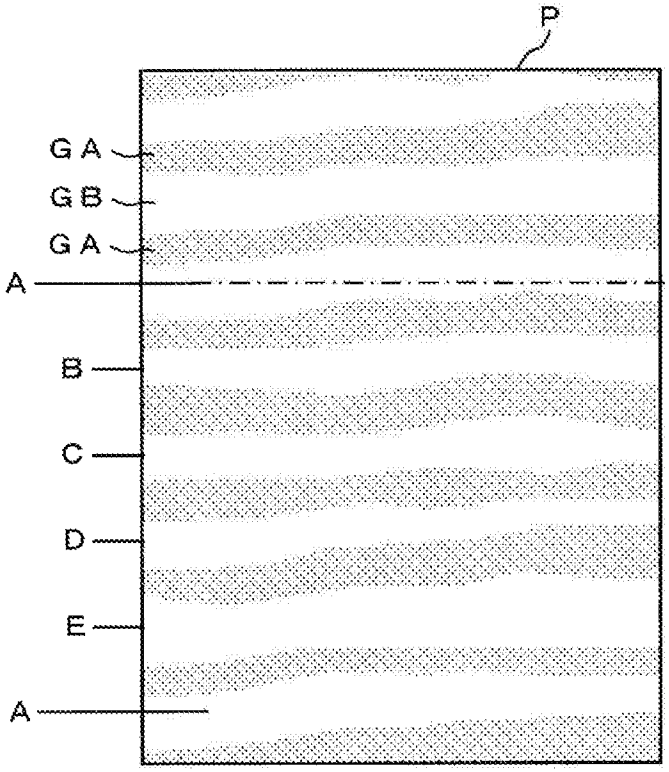
FIG. 6A is an explanatory view illustrating an image output in a state where a period of the photoconductor and a period of a developing sleeve are not in the integer multiple relationship in the image forming apparatus according to the first exemplary embodiment.

FIG. 6A schematically illustrates a banding occurring due to the five petals of the photoconductor 22 when a solid image (a full-page image obtained by setting the image density to 100%) is formed on the paper P, as a comparative example. In addition, the number of rotations of the developing sleeve 28A is, for example, 3 with respect to one rotation of the photoconductor 22. In FIGS. 6A, A, B, C, D, and E correspond to the positions A, B, C, D, and E of the photoconductor 22. In addition, an area GA where the density of the solid image is high (thick) is indicated by dots, and an area GB where the density is low (thin) is indicated in white.

As illustrated in FIG. 6A, in the comparative example where the number of rotations of the developing sleeve 28A is not set to an integer multiple of the number of petals of the photoconductor 22, the width of the area GA having the high image density and the width of the area GB having the low image density are difficult to appear regularly in the transport direction of the paper P, thereby, causing a difference in the image density.

Figure 6B:
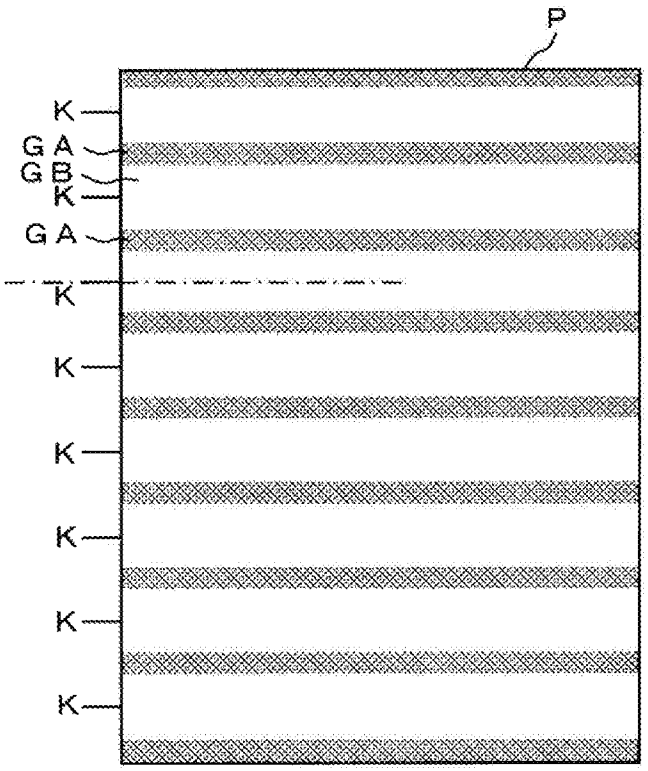
FIG. 6B is an explanatory view illustrating an image output in a state where the period of the photoconductor and the period of the developing sleeve are in the integer multiple relationship in the image forming apparatus according to the first exemplary embodiment.

Meanwhile, in the present exemplary embodiment, the rotation unit 32 rotates the developing sleeve 28A five times which is an integer multiple of the five petals of the photoconductor 22, during one rotation of the photoconductor 22. Accordingly, the variation of the distance L1 between the photoconductor 22 and the developing sleeve 28A becomes regular so that the area GA having the high image density and the area GB having the high image density are arranged regularly in the transport direction of the paper P as illustrated in FIG. 6B. That is, in the image forming apparatus 10, an image in which the area GA having the high image density and the area GB having the low image density appear regularly is output, as compared to the configuration where the developing sleeve 28A is rotated by a number other than an integer multiple of N=5 with respect to one rotation of the photoconductor 22.

Since the area GA having the high image density is arranged regularly, the image correcting unit 19 (see FIG. 1) may perform a correction of the image density such as reducing a development bias in advance in accordance with the position of the area GA having the high image density, so as to obtain substantially the same image density as that of the area GB having the low image density. The development bias corresponds to a potential difference between the photoconductor 22 and the developing sleeve 28A in the above-described development area S. In addition, as another exemplary embodiment, the image correcting unit 19 may perform a correction of the image density such as increasing the development bias in advance in accordance with the position of the area GB having the low image density, so as to obtain substantially the same image density as that of the area GA having the high image density. In this way, the correction of the image density difference within an output image is easy, as compared to the configuration where the periods of the photoconductor 22 and the developing sleeve 28A do not conform to each other.

Second Exemplary Embodiment

Descriptions will be made on an example of an image forming apparatus according to a second exemplary embodiment, with reference to FIGS. 1 to 4, 5A, 5B, 6A, 6B, and 7A to 7C. In addition, the basically identical members and portions to those in the above-described first exemplary embodiment will be denoted by the same reference numerals as used in the first exemplary embodiment, and descriptions thereof will be omitted.

In the image forming apparatus 10 according to the second exemplary embodiment, in one period of the graph G2 (see FIG. 5B) indicating the deflection of the outer circumferential surface of the developing sleeve 28A, a position of the outer circumference where the deflection becomes the smallest is a position K. That is, in the image forming apparatus 10 according to the second exemplary embodiment, the position A where the deflection of the outer circumferential surface 23 of the photoconductor 22 becomes the largest and the position K where the deflection of the outer circumferential surface of the developing sleeve 28A becomes the smallest are disposed to face each other in the development area S. In other words, the photoconductor 22 and the developing sleeve 28A are disposed such that when the radius length r1 of the photoconductor 22 from the center OA thereof is the longest, the radius length r2 of the developing sleeve 28A from the center OB thereof is the shortest.

[Operation]

Descriptions will be made on the operation of the image forming apparatus 10 according to the second exemplary embodiment, with reference to FIGS. 1 to 4, 5A, 5B, 6A, 6B, and 7A to 7C. In addition, descriptions of the same operations as those in the first exemplary embodiment will be omitted.

Figures 7A, 7B, 7C:
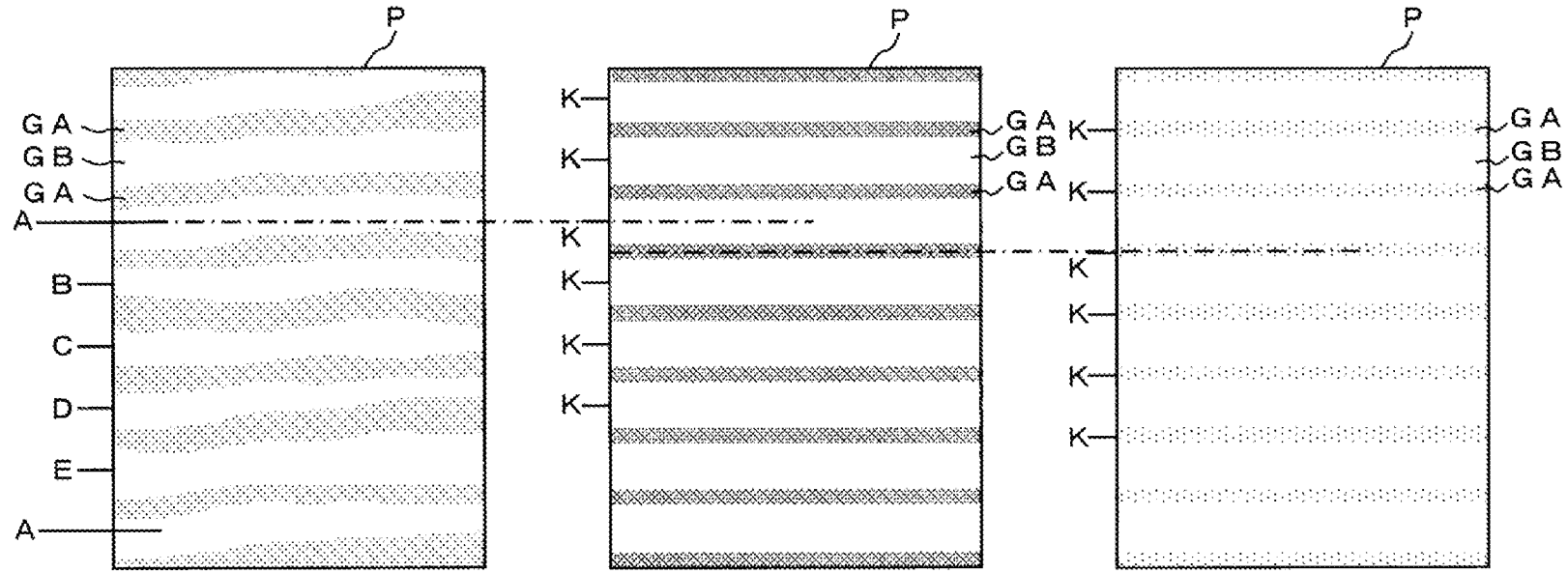
FIG. 7A is an explanatory view illustrating an image output in a state where the period of the photoconductor and the period of the developing sleeve are not in the integer multiple relationship in an image forming apparatus according to a second exemplary embodiment.
FIG. 7B is an explanatory view illustrating an image obtained, as a comparative example, when a position of the photoconductor where the deflection of the photoconductor is large and a position of the developing sleeve where the deflection of the developing sleeve is large are aligned with each other in the image forming apparatus according to the second exemplary embodiment.
FIG. 7C is an explanatory view illustrating an image obtained when the position of the photoconductor where the deflection of the photoconductor is large and a position of the developing sleeve where the deflection of the developing sleeve is small are aligned with each other in the image forming apparatus according to the second exemplary embodiment.
Figure 8A:
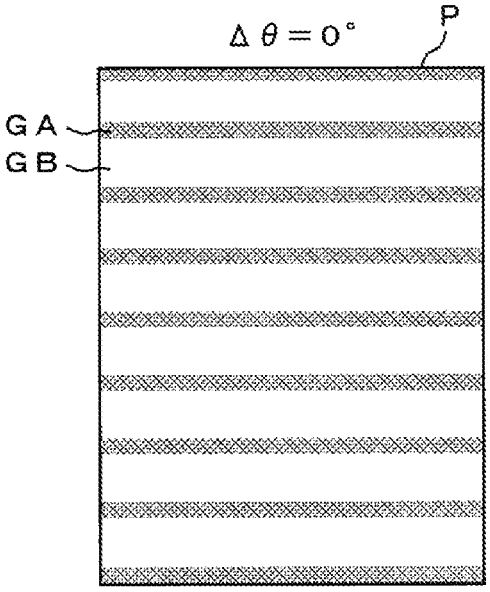
FIGS. 8A, 8B, 8C, and 8D are explanatory views illustrating an image output in a state where the period of the photoconductor and the period of the developing sleeve are deviated from each other in an image forming apparatus according to a third exemplary embodiment.
Figure 8B:
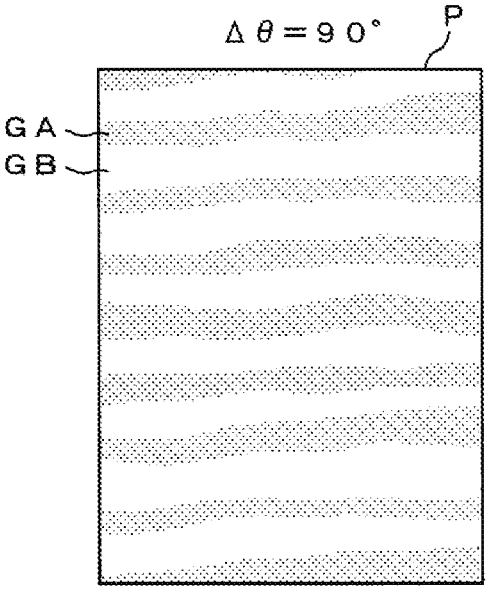
Figure 8C:
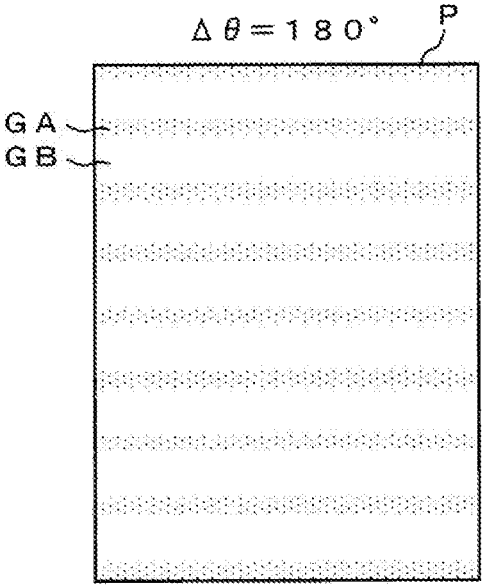
Figure 8D:
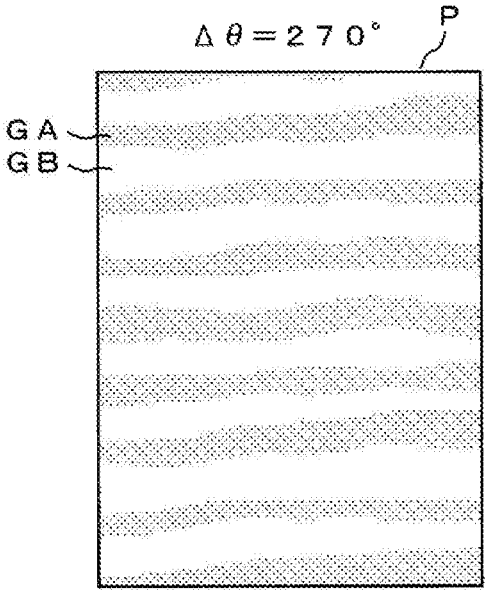

FIG. 7A illustrates an image output in a state where the period of the photoconductor 22 (see FIG. 2) and the period of the developing sleeve 28A (see FIG. 2) are not in the integer multiple relationship, as a comparative example.

When the number of rotations of the developing sleeve 28A is set to an integer multiple (e.g., one time) of the number of petals (N=5) of the photoconductor 22 with respect to one rotation of the photoconductor 22 as in the first exemplary embodiment, the image density has the periodicity as illustrated in FIG. 7B. In addition, FIG. 7B illustrates an image when a position of the outer circumference of the developing sleeve 28A is set to a position where the deflection of the developing sleeve 28A becomes the largest, as a comparative example, with respect to the position A of the photoconductor 22. That is, in this comparative example, the variation of the image density is indicated as a composite wave G3 (see FIG. 5B) in which the position where the deflection of the photoconductor 22 becomes the largest and the position where the deflection of the developing sleeve 28A becomes the largest conform to each other. Accordingly, since the amplitude of the composite wave G3 increases, the image density difference between the area GA having the high image density and the area GB having the low image density within one output image increases.

Meanwhile, in the image forming apparatus 10 according to the second exemplary embodiment, the position A where the radius length r1 of the photoconductor 22 is the longest and the position K where the radius length r2 of the developing sleeve 28A is the shortest are disposed to face each other in the development area S. Accordingly, the vertex of the graph G1 of the photoconductor 22 and the valley of the graph G2 of the developing sleeve 28A are offset so that the amplitude of the composite wave G3 is reduced. Therefore, as illustrated in FIG. 7C, the image density difference between the area GA having the high image density and the area GB having the low image density is reduced. That is, the image density difference within one output image is reduced.

Third Exemplary Embodiment

Descriptions will be made on an example of a developer accommodating device and an image forming apparatus according to a third exemplary embodiment, with reference to FIGS. 1 to 4, 5A, 5B, and 8A to 8D. In addition, the basically identical members and portions to those in the above-described first and second exemplary embodiments will be denoted by the same reference numerals as used in the first and second exemplary embodiments, and descriptions thereof will be omitted.

In the image forming apparatus 10 according to the third exemplary embodiment, the controller 18 has a phase difference setting mode. In the phase difference setting mode, a phase difference $\Delta\theta$ between the deflection (the circumferential variation) of the radius length r1 of the photoconductor 22 and the deflection (the circumferential variation) of the radius length r2 of the developing sleeve 28A is changed, for example, in four (4) stages so as to output four (4) images from the photoconductor 22, and a user is allowed to set (select) the images. Illustration of the phase difference $\Delta\theta$ is omitted. In addition, in the controller 18, the number of rotations of the developing sleeve 28A is preset to five (5) with respect to one rotation of the photoconductor 22, as in the first and second exemplary embodiments. In addition, the four images output in the respective stages from the photoconductor 22 are images prior to a correction by the image correcting unit 19 (see FIG. 1).

In the controller 18, the state in which the position where the deflection of the outer circumferential surface 23 of the photoconductor 22 is the largest and the position where the deflection of the outer circumferential surface of the developing sleeve 28A is the largest face each other in the development area S is set as a state where the phase difference Δθ=0. Further, in the controller 18, the state in which the position where the deflection of the outer circumferential surface 23 of the photoconductor 22 is the largest and the position where the deflection of the outer circumferential surface of the developing sleeve 28A is the smallest face each other in the development area S is set as a state in which the phase difference Δθ=180°.

Further, in the controller 18, a phase difference Δθ=90° and a phase difference Δθ=270° are set as states between the phase difference Δθ=0° and the phase difference Δθ=180°. In order to generate a phase difference Δθ, a timing for starting the rotation of the developing sleeve 28A may be deviated such that a timing when the position A of the outer circumferential surface 23 of the photoconductor 22 reaches the development area S, and a timing when the position K of the developing sleeve 28A reaches the development area S are deviated from each other. As a method of deviating the position K, for example, a method of deviating the timing for starting the rotation by using a rotary encoder (a position sensor) (not illustrated) or a timer (not illustrated) may be performed. As described above, in the controller 18, the phase difference Δθ is set in four stages of 0°, 90°, 180°, and 270°.

In addition, in the image forming apparatus 10 according to the third exemplary embodiment, one of the images obtained by changing the phase difference in the four stages is selected on the operation panel 13. Specifically, the operation panel 13 displays, for example, four (4) buttons of the phase difference Δθ=0°, 90°, 180°, and 270° (not illustrated). Then, a user views the four output images, selects which is an image having a favorable phase difference, and presses the button of the corresponding phase difference so as to set the phase difference Δθ in the controller 18. A favorable image sample is provided in advance to the user. The rotation unit 32 rotates the photoconductor 22 and the developing sleeve 28A with the phase difference Δθ corresponding to the image set (selected) on the operation panel 13.

[Operation]

Descriptions will be made on the operation of the image forming apparatus 10 according to the third exemplary embodiment, with reference to FIGS. 1 to 4, 5A, 5B, and 8A to 8D. In addition, descriptions of the same operations as those in the first and second exemplary embodiments will be omitted.

When the phase difference setting mode is selected by the user on the operation panel 13, the controller 18 changes the phase difference Δθ in the above-described four stages and outputs the four images. As illustrated in FIGS. 8A, 8B, 8C, and 8D, in the four images, when the phase difference Δθ varies, the intensity of the image density or the arrangement (regularity) of the area GA having the high image density and the area GB having the low image density varies within one image. In addition, the controller 18 stores the phase difference Δθ selected on the operation panel 13, and furthermore, rotates the photoconductor 22 and the developing sleeve 28A by the rotation unit 32 in accordance with the selected phase difference Δθ for the next image formation.

As described above, in the image forming apparatus 10 according to the third exemplary embodiment, since the phase difference Δθ is set (selected) in the controller 18 to obtain a desired image, the phase difference between the photoconductor 22 and the developing sleeve 28A is set without requiring the user to operate the photoconductor 22 and the developing sleeve 28A.

Fourth Exemplary Embodiment

Descriptions will be made on an example of a developer accommodating device and an image forming apparatus according to a fourth exemplary embodiment, with reference to FIGS. 1 to 4, 5A, 5B, and 9. The basically identical members and portions to those in the above-described first to third exemplary embodiments will be denoted by the same reference numerals as used in the first to third exemplary embodiments, and descriptions thereof will be omitted.

In the image forming apparatus 10 according to the fourth exemplary embodiment, the controller 18 has an image output mode and a phase difference selection mode.

The controller 18 has the image output mode, and a user selects the image output mode on the operation panel 13. In addition, in the image output mode, the developing sleeve 28A is rotated such that the period N of the variation in the circumferential direction of the radius length r1 of the photoconductor 22 and the period of the rotation of the developing sleeve 28A which is an integer multiple of the N are deviated in phase from each other, and one toner image G (image G) including plural phase difference data is output. In other words, in the image output mode, the developing sleeve 28A is rotated by a number other than an integer multiple of the N during one rotation of the photoconductor 22. In addition, in the present exemplary embodiment, the developing sleeve 28A is set to be rotated, for example, at a circumferential speed corresponding to 2 times a set speed in order to deviate the periods.

Figure 9:
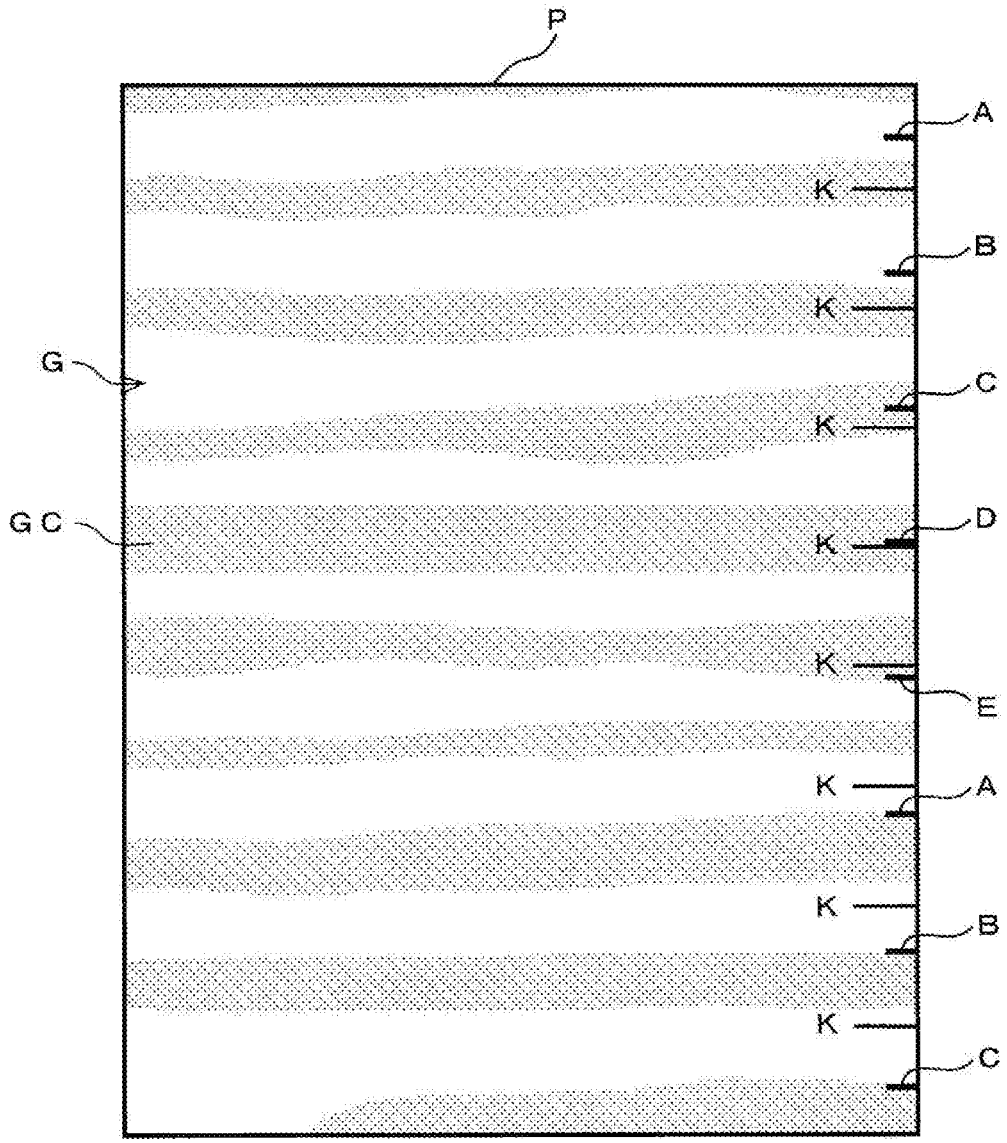
FIG. 9 is an explanatory view illustrating an image output in a state where the period of the photoconductor and the period of the developing sleeve are deviated from each other, and respective markers in an image forming apparatus according to a fourth exemplary embodiment.

As illustrated in FIG. 9, in the end portion of the image G, each of markers corresponding to the positions A, B, C, D, and E of the outer circumferential surface 23 of the photoconductor 22 (see FIG. 2) and markers corresponding to the position K of the outer circumferential surface of the developing sleeve 28A is indicated by one line. In the present exemplary embodiment, the deviation amount of the position K from each of the positions A, B, C, D, and E becomes phase difference data. That is, the end portion of the image G includes plural phase difference data.

In the phase difference selection mode, a result of the execution of the image output mode is automatically displayed on the operation panel 13. In addition, in the phase difference selection mode, the controller 18 allows a user to select one of the plural phase difference data in the image obtained by the image output mode.

Specifically, the user views the image G on one paper P obtained by the image output mode and selects a portion where the irregularity of the image density in the transport direction of the paper P is the lowest (a favorable portion of the image). Here, it is assumed that the user selects, for example, a partial image GC of the image G. In addition, the user reads a combination of the markers closest to the selected partial image GC. Here, the combination of the markers closest to the partial image GC is the combination of the positions K and D. In addition, in FIG. 9, the alphabets A, B, C, D, E, and K may be indicated on the markers (lines).

Subsequently, the user selects the combination of the markers to be set from the plural combinations on the operation panel 13. The operation panel 13 selectively displays, for example, five (5) buttons K-A, K-B, K-C, K-D, and K-E. Then, when the user presses (selects), for example, the button K-D, the position D of the photoconductor 22 and the position K of the developing sleeve 28A are determined as the facing positions in the development area S. In addition, the rotation unit 32 may deviate the rotation start timings of the photoconductor 22 and the developing sleeve 28A from each other such that the selected positions D and K face each other in the development area S.

After the image output mode and the phase difference selection mode are terminated, the controller 18 rotates the photoconductor 22 and the developing sleeve 28A such that the period N of the variation in the circumferential direction of the outer circumferential surface 23 of the photoconductor 22 and the period of the rotation of the developing sleeve 28A which is an integer multiple of the N are synchronized with each other.

[Operation]

Descriptions will be made on the operation of the image forming apparatus 10 according to the fourth exemplary embodiment, with reference to FIGS. 1 to 4, 5A, 5B, and 9. In addition, descriptions of the same operations as those in the first, second, and third exemplary embodiments will be omitted.

When the image output mode is selected by the user on the operation panel 13, the controller 18 operates the rotation unit 32 to rotate the developing sleeve 28A, for example, at a circumferential speed corresponding to two times a set speed. Then, the controller 18 causes an image including the markers corresponding to the positions A, B, C, D, and E of the photoconductor 22 and the markers corresponding to the position K of the developing sleeve 28A to be formed by using the toner T, and outputs the image as the image G on one paper P (see FIG. 9).

Subsequently, after the output of the paper P, the controller 18 causes the operation panel 13 to display the selection buttons K-A, K-B, K-C, K-D, and K-E. Then, the controller 18 operates the rotation unit 32 such that the position (e.g., the position D) of the photoconductor 22 selected by the user and the position K of the developing sleeve 28A face each other in the development area S, and stores the information of the combination of the positions D and K.

After the image output mode and the phase difference selection mode are terminated, the controller 18 rotates the photoconductor 22 and the developing sleeve 28A such that the period N of the variation in the circumferential direction of the outer circumferential surface 23 of the photoconductor 22 and the period of the rotation of the developing sleeve 28A which is an integer multiple of the N are synchronized with each other.

As described above, in the image forming apparatus 10 according to the fourth exemplary embodiment, since the phase difference $\Delta\theta$ is set (selected) to obtain a desired image, the phase difference between the photoconductor 22 and the developing sleeve 28A is set without requiring the user to operate the photoconductor 22 and the developing sleeve 28A. In addition, since the phase difference is set by forming the image G as one test pattern, the setting of the phase difference between the photoconductor 22 and the developing sleeve 28A becomes simple, as compared to the configuration where the phase difference is set by outputting plural images.

In addition, the present invention is not limited to the above-described exemplary embodiments.

The image forming apparatus 10 is not limited to the two-component developer including the carrier C and the toner T, and a one-component developer including no carrier C may be used.

The photoconductor 22 may be any photoconductor of which the deflection of the outer circumferential surface 23 is formed in the flower shape having N petals, and is not limited to the photoconductor including the joints 43. That is, the cause of the flower shape having N petals is not limited to the joints 43, and the flower shape may be formed due to other factors such as a shaping accuracy. In addition, the number N of petals of the photoconductor 22 is not limited to 5, and may be plural petals such as 2, 3, 4 or 6 petals. Further, with respect to the outer circumferential surface 23 of the photoconductor 22, the threshold value of the value of the deflection, which is regarded as one petal (N=1), is not limited to 4 μm, but may be set to other values.

When a non-magnetic one-component developer is used, the developing roller 28 does not require the magnet roller 28B. The period (the number of rotations) of the developing sleeve 28A is not limited to one time the N, and may be set to two or more times the N. However, the period is required to be set within the above-described upper limit.

The rotation unit 32 is not limited to the rotation unit including the first and second motors 34 and 36 and may be provided with one motor, plural gears, and a coupling capable of switching a connection so as to rotate the photoconductor 22 and the developing sleeve 28A.

The operation panel 13 is not limited to the touch panel and may be a combination of a liquid crystal screen and mechanical buttons.

In the image forming apparatus 10 according to the fourth exemplary embodiment, instead of the position K where the deflection of the outer circumferential surface of the developing sleeve 28A becomes large, another position where the deflection of the outer circumferential surface of the developing sleeve 28A becomes small may be set and disposed to face the position D of the photoconductor 22 in the development area S. In other words, in the image forming apparatus 10 according to the fourth exemplary embodiment, a phase of an initial position K of the outer circumferential surface of the developing sleeve 28A may be deviated by 180°.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member comprising an outer circumferential surface in which a length of a radius from a center of the image holding member varies to be the longest N times and the shortest N times during one rotation of the image holding member wherein N is an integer of 2 or more, the image holding member being configured to hold a latent image while being rotated;

a developing member configured to develop the latent image of the image holding member with a developer;

a rotation unit configured to rotate the developing member by a number of an integer multiple of N during the one rotation of the image holding member;

a controller configured to change a phase difference between a first predetermined position of an outer circumferential surface of the developer member and a second predetermined position of an outer circumferential surface of the image forming member; and an output unit configured to output a developer image of the image holding member to a recording medium, wherein a portion of the image holding member at which the radius from the center is the longest is configured to be positioned in a development area at the same time as a portion of the developing member at which the radius from the center is the shortest.

2. The image forming apparatus according to claim 1, wherein the output unit is configured to change, in a plurality of stages, a phase difference between a variation in a circumferential direction of the outer circumferential surface of the image holding member and a variation in a circumferential direction of an outer circumferential surface of the developing member to output a plurality of images from the image holding member, each one of the plurality of images corresponding to one of the stages, the image forming apparatus further comprises an image selecting unit configured to select one of the plurality of images, and the rotation unit is configured to rotate the image holding member and the developing member with a phase difference corresponding to an image selected by the image selecting unit.

3. The image forming apparatus according to claim 1, wherein the output unit includes an image output mode in which the developing member is rotated by a number other than the integer multiple of N during the one rotation of the image holding member, and an image containing a plurality of phase difference data for the image holding member and the developing member is output, and wherein the output unit includes a phase difference selection mode in which one of the plurality of phase difference data is selected.

4. The image forming apparatus according to claim 1, wherein the image holding member comprises a cylindrical base including a plurality of plates, and wherein N is the number of plates.

* * * * *